United States Patent [19]

Jamshidi

[11] 4,183,300

[45] Jan. 15, 1980

[54] METHOD OF IMPRINTING CHARACTERS ON ADHESIVE BEARING TAPES

[76] Inventor: Khosrow Jamshidi, 610 Winston Ct., St. Paul, Minn. 55118

[21] Appl. No.: 873,794

[22] Filed: Jan. 31, 1978

[51] Int. Cl.[2] ..... B41J 3/24; B44B 7/00

[52] U.S. Cl. ..... 101/426; 101/3 R; 101/24; 101/26; 400/85; 400/135

[58] Field of Search ..... 101/24, 3 R, 426, 26, 101/23; 400/85, 135

[56] References Cited

U.S. PATENT DOCUMENTS

| | | | |
|---|---|---|---|
| 1,448,994 | 3/1923 | Dauley et al. | 101/24 |
| 1,480,690 | 1/1924 | Peters | 101/24 |
| 1,731,376 | 10/1929 | Goodstein | 400/85 |
| 1,815,716 | 7/1931 | Ker | 101/24 |
| 1,916,661 | 7/1933 | Flothow | 101/25 |
| 2,320,925 | 6/1943 | Grant | 101/3 R |
| 2,598,892 | 6/1952 | Critchlow, Jr. et al. | 101/426 X |
| 2,722,038 | 11/1955 | Freund | 101/31 |
| 2,802,412 | 8/1957 | Lecluyse et al. | 101/36 |
| 2,994,263 | 8/1961 | Rus | 101/11 |
| 3,097,592 | 8/1963 | Friedman | 101/6 |
| 3,515,059 | 6/1970 | Sciame | 101/31 |
| 3,783,783 | 1/1974 | Hamisch | 101/26 |
| 3,961,575 | 6/1976 | Rodabaugh | 101/9 |
| 4,023,482 | 5/1977 | Swett et al. | 101/19 |
| 4,034,667 | 7/1977 | Cartwright et al. | 101/27 |

*Primary Examiner*—William Pieprz

*Attorney, Agent, or Firm*—Orrin M. Haugen; Thomas J. Nikolai

[57] ABSTRACT

A method for imprinting alphanumeric or other characters on an adhesive bearing tape of the type having an antiblocking layer or coating on the surface of the tape which is opposite to the surface having the adhesive coating thereon. The method includes the steps of providing a printing plate having a plurality of pin-like projections defining the characters to be printed, coating the pin-like projections with ink, and bringing the ink bearing pins into contact with the tape with sufficient force that the pins penetrate the antiblocking layer and deposit the ink into the tape media below the antiblocking layer.

5 Claims, 3 Drawing Figures

METHOD OF IMPRINTING CHARACTERS ON ADHESIVE BEARING TAPES

BACKGROUND OF THE INVENTION

I. Field of the Invention

This invention relates generally to a novel printing method, and more specifically to a method of imprinting characters on an adhesive bearing tape medium in such a fashion that the ink penetrates beneath any antiblocking layer which may be present on the surface of the medium opposite to the one on which the adhesive is coated. As such, following the printing step, the tape may be rolled and subsequently unrolled for dispensing without smearing or obliterating the printed characters.

II. Description of the Prior Art

In preparing labels and the like, it is desirable that one be able to imprint a predetermined message or other information on an adhesive bearing tape, which tape can be rerolled following printing so that the ultimate user may draw a preprinted strip of tape from the roll and use it as a label. In order to facilitate the unrolling of an adhesive bearing ribbon or tape, it is common practice to employ a suitable antiblocking layer on the surface of the tape which is opposite to the one on which the adhesive layer is coated. This antiblocking layer is typically a silicone compound which prevents the adhesive surface from strongly attaching itself to the non-adhesive side of the tape when rolled. While the antiblocking layer facilitates the unrolling and dispensing of the adhesive tape, it does not provide a convenient surface on which to imprint alphanumeric or other characters with ink. The smooth, non-porous antiblocking layer does not absorb conventional printing inks and as a result, when the preprinted adhesive tape is dispensed from the roll, the ink material is often smeared or obliterated or removed by the adhesive layer.

In accordance with the teachings of the present invention, I provide a method whereby pressure sensitive adhesive tapes having an antiblocking layer on one surface and an adhesive layer on the opposite surface may be drawn off from a roll, printed with characters and rerolled prior to the end use of the tape as a label. The novel method employs the use of a printing plate having the desired characters defined by pin-like projections extending from the surface thereof. The pin-like projections defining the characters to be printed are next coated with a suitable printing ink and then brought in contact with the antiblocking layer surface of the adhesive tape with sufficient force that the pin-like projections penetrate through the antiblocking layer and deposit the ink within the tape media in a manner somewhat analogous to tattooing. Following the printing step, the tape may be rerolled such that the adhesive surface cooperates with the antiblocking surface on an adjacent layer. Because of the manner in which the ink is injected through the antiblocking layer, this antiblocking layer is not destroyed and it continues to serve its purpose of facilitating the subsequent unrolling of the tape from the roll by the ultimate user.

The closest prior art of which I am aware relates to so-called check protectors of the type disclosed in the Peters Pat. No. 1,480,690 and the Dauley et al U.S. Pat. No. 1,448,994. In each of these arrangements a type wheel having projections for perforating paper are passed over an inking roller and then brought in contact with a paper medium such as a bank check. The purpose, of course, is to inhibit subsequent alteration of the information printed on the check blank. Because of the manner in which the paper is perforated and inked, attempts at erasure will destroy the paper.

OBJECTS

It is accordingly a principal object of the present invention to provide a novel method for imprinting characters on an adhesive bearing medium.

Another object of the invention is to provide a novel method of imprinting characters on an adhesive bearing medium of the type which further includes an antiblocking layer on the non-adhesive surface thereof.

Still another object of the invention is to provide a novel printing method whereby characters are printed by injecting the ink through the antiblocking layer on the adhesive tape medium.

Yet another object of the invention is to provide a method for imprinting characters on prepared adhesive tapes of the type having a pressure sensitive adhesive on one surface thereof and an antiblocking layer on the opposite surface such that following printing the adhesive tape may be rerolled and later withdrawn from the roll without obliterating or removing the printed characters.

These and other objects and advantages of the invention will become apparent to those skilled in the art from a following detailed description of the preferred embodiment, especially when considered in light of the accompanying drawings.

DETAILED DESCRIPTION OF THE PREFERRED EMBODIMENT

Figure 1:
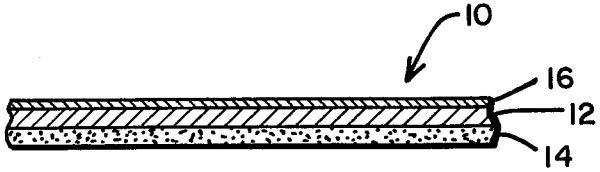
FIG. 1 is a cross-sectional view showing the tape medium on which printing is to be made.

Referring first to FIG. 1, there is shown a cross-sectional view of a typical adhesive tape of the type which may be printed upon through the use of the method of this invention. The tape is generally indicated by numeral 10 and includes an intermediate layer 12 which may be paper, cloth or other suitable backing material. Disposed on the undersurface of the backing layer 12 is an adhesive layer 14 which comprises a coating of a suitable pressure sensitive adhesive material. On the opposite side of the backing layer 12 there is provided a so-called antiblocking layer 16. The layer 16 may comprise a coating of a suitable silicone compound commonly used in the manufacture of adhesive tapes. This antiblocking layer permits an elongated strip of the tape to be rolled upon itself. The adhesive layer 14 does not adhere as strongly to the antiblocking layer 10 as it does to untreated backing material. As such, later unrolling of the tape is facilitated.

While the antiblocking layer 16 serves a useful purpose in facilitating the unrolling of the adhesive tape, it does not provide a suitable medium on which characters may be imprinted with conventional printing inks. The antiblocking layer 16 is generally non-porous and if an attempt is made to print information thereon in a conventional printing operation, subsequent unrolling of the tape will cause the ink to be removed by the adhesive layer 14. This, of course, destroys the quality of the printing and may render it illegible.

Figure 2:
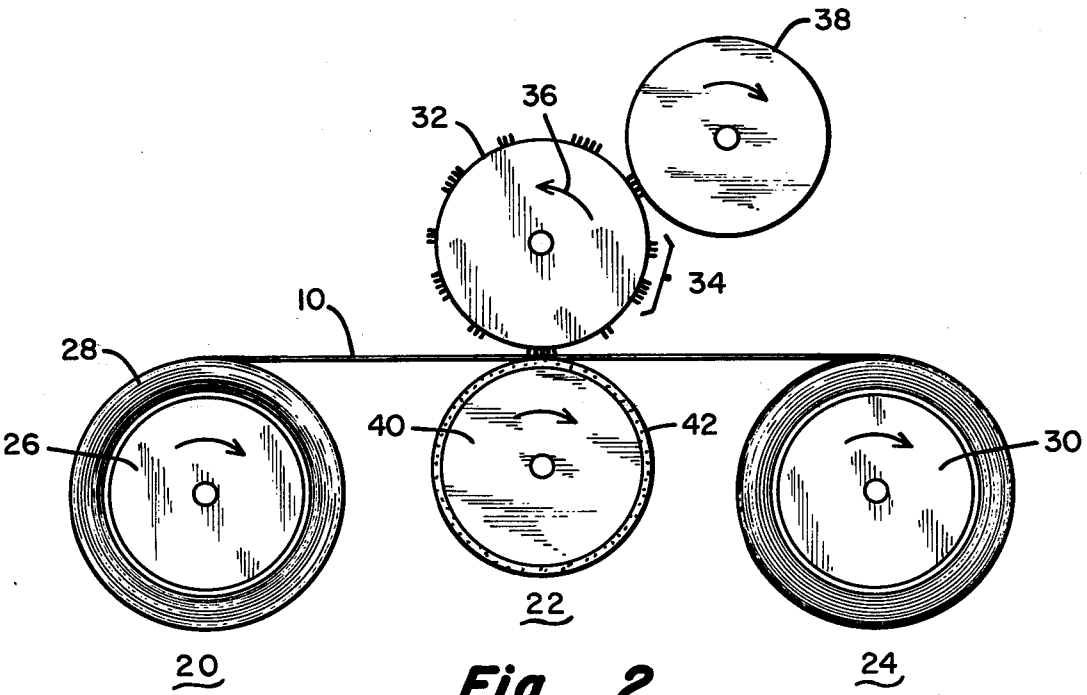
FIG. 2 is a schematic mechanical drawing of apparatus which may be used in carrying out the method of this invention.

With reference to the schematic diagram of FIG. 2, the steps in the process will next be set forth. The system may be comprised of three stations, namely a supply station indicated generally by numeral 20, a printing station indicated by numeral 22 and a take-up station identified by numeral 24. Disposed at the supply station is a roller 26 onto which may be positioned a roll of adhesive tape 28. The tape will have the construction as set forth in FIG. 1.

The outer end of the roll of tape is routed past the printing station 22 and affixed to the take-up spool 30 located at the take-up station 24. The reel 30 is adapted to be driven by a source of rotational power at a predetermined rate.

Located at the printing station 22 is a print wheel 32 which, in FIG. 2, is generally cylindrical and which has a plurality of pin-like projections as at 34 extending outwardly from the surface thereof. These projections 34 are disposed on the cylinder 32 so as to define a pattern of characters to be printed. That is, the location and spacing between pins define alphanumeric or other characters to be printed. The print wheel 32 is driven by a suitable source of motive power in the direction indicated by the small arrow 36. As the wheel 32 rotates, the pins 34 come into contact with the surface of an inking roller 38. Thus, as the pin-like projections 34 pass the inking roller 38, ink is deposited on the pin-like projections defining the characters.

Also located at the printing station 22 is a backing roller 40 which has its axis of rotation parallel to the axis of rotation of the print wheel 32. The backing roller 40 is provided with a resilient material 42 on its peripheral surface. The backing roller 40 is positioned relative to the print wheel 32 such that a single strip of the adhesive tape 10 to be imprinted with characters may pass therebetween. The length of the pin-like projections 34 with respect to the predetermined spacing maintained between the print wheel 32 and the backing wheel 40 is such that a force sufficient to allow the pin-like projections to penetrate through the antiblocking layer 16 of the tape 10 is available. Thus, the ink which is present on the surface of the pin-like projections 34 is injected through the antiblocking layer 16 of the tape 10 and is deposited on the material 12 (FIG. 1).

Because the characters to be printed are effectively injected through the antiblocking layer 16 of the tape 10, it is immaterial that the tape is again rerolled at the take-up station 24, as far as the quality of the printing is concerned. Because the pattern of characters is injected through the antiblocking layer 16 and deposited within the tape material layer 12, the printed characters will not peel off from the tape when it is ultimately withdrawn from the take-up reel when ultimately used. Were it not for the fact that the ink is injected through the antiblocking layer, the printed characters would tend to adhere to the adhesive layer as the preprinted tape is withdrawn from its roll during ultimate use.

It should be understood that the apparatus illustrated in FIG. 2 is schematic only and may be modified in carrying out the method of this invention. More specifically, rather than providing a print wheel 32, it may be desired to provide a printing plate which is planar in character but which has a pattern of pin-like projections extending outwardly from a flat surface thereof. Again, the pin-like projections would define the shape of the characters to be printed. In using a flat printing plate, an incremental drive would be utilized at the take-up station 24 and the printing plate and a backing plate having a resilient material on its outer surface would be moved in a reciprocating fashion, toward and away from one another during the printing operation. The printing plate and its associated backing plate would be positioned on opposite sides of the strip of tape 10 with the printing plate being on the side proximate the antiblocking layer 16. The printing plate and its associated backing plate would be brought together with a sufficient force such that the pin-like projections on the printing plate which define the characters will penetrate the antiblocking layer 16, all as has previously been described.

Figure 3:
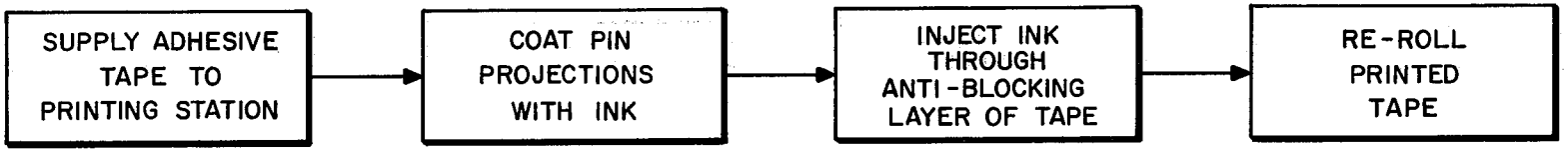
FIG. 3 is a block diagram illustrating the steps of the novel method.

FIG. 3 illustrates by means of a flow diagram the various steps in carrying out the process of the instant invention. A roll of commercially available ahdesive tape such as SCOTCH ® brand masking tape manufactured by the Minnesota Mining and Manufacturing Company of St. Paul, Minnesota, is positioned on a supply roll and the free end thereof is routed past a printing station and affixed to a take-up roll. Masking tape of the type described has a paper composition core and on one surface thereof is a suitable adhesive and on the opposite surface is an antiblocking layer that limits the adhesive force which would otherwise exist between the adhesive layer and the paper composition backing layer. Thus, the antiblocking layer facilitates the removal of tape from the roll.

As is indicated by the next block in FIG. 3, at the printing station there is provided a printing plate having a pattern of pin-like projections defining the characters to be printed. The term "printing plate" is intended to include not only flat plates, but also a cylindrical print roller. At the printing station, the pin-like projections on the printing plate are first coated with ink.

Subsequently, the ink coated pins are brought into contact with the antiblocking layer on the surface of the adhesive tape with a sufficient force that the pins penetrate through the antiblocking layer and inject the ink onto the material which supports the adhesive layer.

Following the printing step, the printed tape is rerolled on a suitable core at the take-up station so that the now-printed tape may be subsequently dispensed by the ultimate user.

This invention is capable of numerous forms and various applications without departing from the essential features herein disclosed. It is therefore intended and desired that the embodiment disclosed herein shall be deemed merely illustrative and not restrictive and that the patent shall cover all patentable novelty herein set forth; reference being had to the following claims rather than to the specific description herein, to indicate the scope of this invention.

What is claimed is:

1. A method of printing characters on an ink-absorbing medium having a pressure sensitive adhesive on one surface thereof and an antiblocking coating nonreceptive to ink on the opposite surface thereof, comprising the steps of:

(a) providing a printing plate having a pattern of pin-like projections extending from a surface thereof defining characters to be printed;

(b) coating said pattern with an ink; and (c) bringing said coated pattern into contact with said opposite surface of said medium with sufficient force such that said pin-like projections penetrate through said antiblocking coating to deposit ink on said medium.

2. The method as in claim 1 wherein said medium comprises an elongated strip of flexible material.

3. The method as in claim 2 wherein said material is a paper composition.

4. The method as in claim 2 wherein said material is a cloth fabric.

5. A method of imprinting characters on a flexible tape of the type including a ink-absorbing material having a pressure sensitive adhesive on one surface thereof and a non-ink-absorbing antiblocking layer on the opposite surface thereof, comprising the steps of:

(a) withdrawing a length of said tape from a supply roll;

(b) providing a printing plate having a pattern of pin-like projections extending from a surface thereof defining characters to be printed;

(c) applying ink to said pattern;

(d) routing said length of tape by said printing plate to a take-up roll; and (e) bringing the inked pattern on said printing plate into contact with said non-ink-absorbing antiblocking layer with sufficient force so that said pin-like projections penetrate through said non-ink-absorbing antiblocking layer to deposit ink on said ink-absorbing material.

* * * * *